United States Patent [19]

Sargent

[11] 4,260,281

[45] Apr. 7, 1981

[54] METHOD AND APPARATUS FOR STABILIZING A FILL SLOPE

[75] Inventor: Claud B. Sargent, Biloxi, Miss.

[73] Assignee: Michael P. Breston, Houston, Tex.; a part interest

[21] Appl. No.: 739,901

[22] Filed: Nov. 8, 1976

[51] Int. Cl.[3] ..... E01C 19/26

[52] U.S. Cl. ..... 404/127; 404/117

[58] Field of Search ..... 404/117, 103, 127, 83, 404/122, 96, 133, 84; 180/64 R, 64 M, 64 MM, 64 L, 41

[56] References Cited

U.S. PATENT DOCUMENTS

| | | | |
|---|---|---|---|
| 1,559,406 | 10/1925 | Carson | 61/63 |
| 2,170,330 | 8/1939 | Joedicke | 404/127 |
| 2,572,109 | 10/1951 | Coates | 180/64 MM |
| 2,796,685 | 6/1957 | Bensinger | 404/84 X |
| 3,069,984 | 12/1962 | Kammerlin | 404/117 |
| 3,242,835 | 3/1966 | Paramythioti | 404/127 |
| 3,302,540 | 2/1967 | Fuentes | 404/127 |
| 3,366,021 | 1/1968 | Hanson | 404/103 X |
| 3,516,341 | 6/1970 | Olsen | 404/103 |
| 3,554,291 | 1/1971 | Rogers | 404/84 X |
| 3,792,748 | 2/1974 | Regier | 180/41 X |
| 3,857,533 | 12/1974 | Mason | 180/41 X |

FOREIGN PATENT DOCUMENTS

| | | | |
|---|---|---|---|
| 996868 | 6/1965 | United Kingdom | 404/127 |
| 179353 | 4/1966 | U.S.S.R. | 404/127 |

*Primary Examiner*—Nile C. Byers, Jr.

*Attorney, Agent, or Firm*—Michael P. Breston

[57] ABSTRACT

A two-to-one or greater slope is stabilized by rolling a vibratory compactor upslope and simultaneously vibrating the compactor's roller. The compactor comprises a frame on which is rotatably mounted a suitable compaction roller. An engine is rotatably mounted on the frame, and means are provided for adjusting the tilt of the engine relative to the frame, so that, in use, the engine will remain upright while driving the vibratory shaft of the roller. The engine is remotely controlled, as by radio waves, by an operator riding a vehicle on the shoulder of the embankment. A crane and winch on the vehicle riding on the embankment control the movements of the compactor on the slope.

5 Claims, 11 Drawing Figures

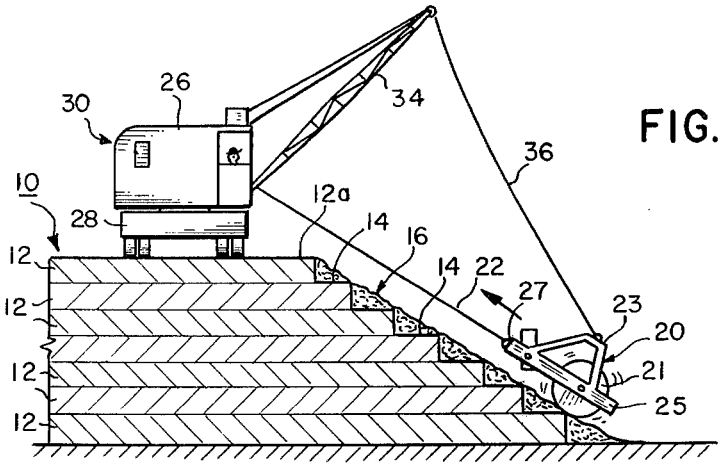
FIG. 2.
FIG. 1.
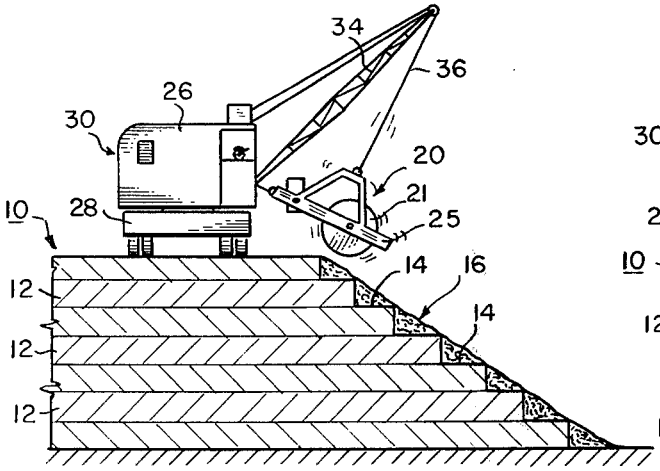
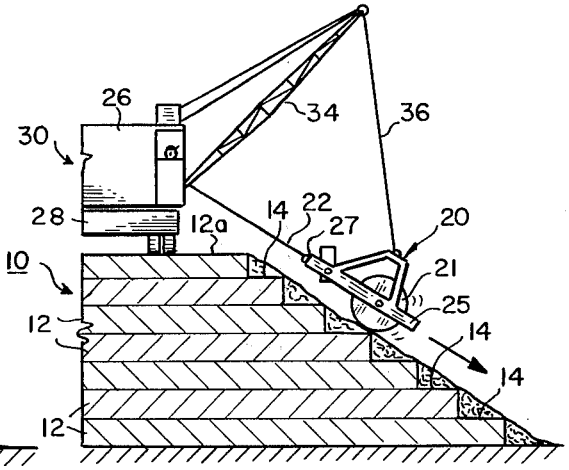
FIG. 3.
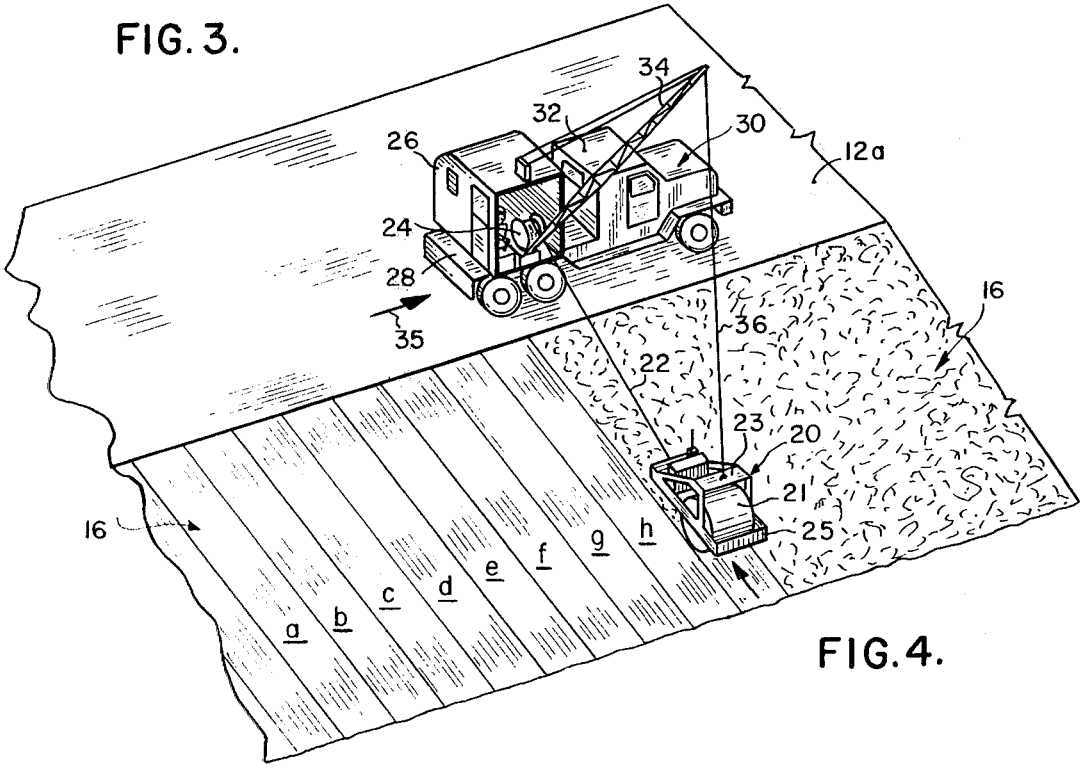
FIG. 4.

METHOD AND APPARATUS FOR STABILIZING A FILL SLOPE

BACKGROUND OF THE INVENTION (a) Field of the Invention

This invention relates to the art of constructing slopes and, more particularly to an improved method and apparatus for stabilizing fill slopes.

(b) Description of the Prior Art

In the process of building roads, highways, dams, embankments, etc., there is a requirement for stabilizing their slope surfaces, both when the slopes are initially constructed, and when the slopes are being reconstructed.

Relatively-flat earth fill surfaces are typically best stabilized with the use of well-known vibratory compactors. A typical such vibratory compactor comprises a main frame, a roller rotatably mounted on the frame, and an engine fixedly-mounted upright on the frame for driving the vibratory shaft of the roller. For relatively flat earth filled surfaces and for slopes less than two-to-one, the use of a vibratory compactor can produce the desired compaction effects, such as are prescribed in typical construction specifications.

However, it was generally believed by those skilled in the art that vibratory compactors could not be employed for compacting slopes, equal to or steeper than about two-to-one, hereinafter and in the claims called "regular slopes", which are the most widely used slopes. As a consequence, the outer surfaces of regular fill slopes are presently compacted much less than flat fill surfaces and fill slopes less than two-to-one, hereinafter sometimes called "irregular slopes". In other words, no commercially practical method is presently available for adequately compacting the outer surfaces of regular slopes.

In the construction or reconstruction of regular slopes, when the roller is first gradually released downslope, it will erode the fill material on the slope's surface. Then, when the same roller is pulled upslope over the eroded surface, it only slightly compacts the slope's fill material. The greater the number of downslope-upslope roller passes, the more a regular slope will erode, whereas on flat surfaces and on irregular slopes, the greater the number of passes, the greater the compaction effect becomes. Regular slopes are presently being treated with a non-vibratory roller, and are therefore not being compacted with a vibratory compactor.

The industry has of necessity standardized on the requirement that an average of about three complete roller passes, regardless of their respective compaction effects, will be accepted as meeting the lower compaction standards set for regular fill slopes, provided that the roller meets certain mechanical specifications, as to size, weight, etc.

For judging the compactness of flat earth fill surfaces, the criterion is typically expressed as a percentage, say 85 to 95%, of the maximum achievable on site compaction. While such high compaction effects are achievable with known vibratory compactors on flat earth fill surfaces and on the surfaces of irregular slopes (less than two-to-one), the compaction effects achievable on the outer surfaces of regular slopes (greater than two-to-one) are substantially less than 85%, typically say between 35% and 65% of maximum compaction.

This inferior achievable compaction is primarily responsible for the relatively rapid deterioration of regular slopes, especially in regions characterized by high winds and heavy rains. Millions of dollars are annually spent for the repair of slope-supported structures which are damaged as a result of eroded slopes, and for the reconstruction of the eroded slopes.

Additionally, the sloughed fill materials from eroding slopes frequently end up in streams and rivers, causing damage to wildlife, and polluting their waters, as well as adjacent agricultural fields.

It is a general object of my invention to provide a method and an apparatus for stabilizing regular slopes, i.e., two-to-one or greater, to substantially the same standards of compaction imposed by the construction industry on flat earth surfaces and irregular slopes, i.e., less than two-to-one, thereby eliminating the above described environmental problems caused by insufficiently compacted slopes, such as are produced with presently known earth fill compaction methods.

SUMMARY OF THE INVENTION

The method for stabilizing a fill slope of an embankment comprises positioning a vibratory compactor at the toe of the slope, initiating the vibration of its roller, and pulling the compactor upslope with the roller vibrating.

When the compactor is moved downslope, the roller is not allowed to vibrate. The preferred apparatus for carrying out the method of the invention is a vibratory compactor which includes a main frame, one or more rollers rotatably mounted on the main frame, and an engine for vibrating the rollers.

If an upright engine is employed, the engine is rotatably-mounted on the frame, and adjusting means are provided for adjusting the tilt of the engine relative to the frame, whereby the engine will remain, in use, upright on the slope being compacted.

The vibratory compactor is typically moved about from a truck crane driving on the shoulder of the embankment, and the operations of the roller's engine are preferably remotely controlled, as by radio signals.

BRIEF DESCRIPTION OF THE DRAWINGS

FIGS. 1-4 illustrate the steps used in carrying out a preferred method of constructing a compaction-stabilized, regular fill slope;

DETAILED DESCRIPTION OF THE METHOD OF THE INVENTION

Figure 5:
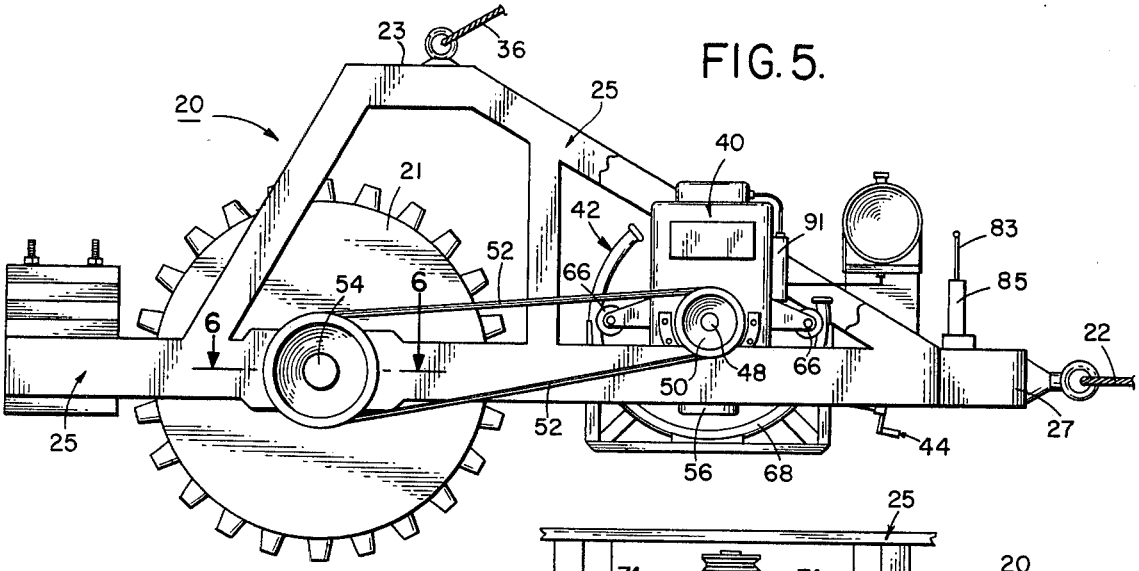
FIG. 5 is a side view in elevation of a vibratory compactor adapted for carrying out the method of my invention.
Figure 8:
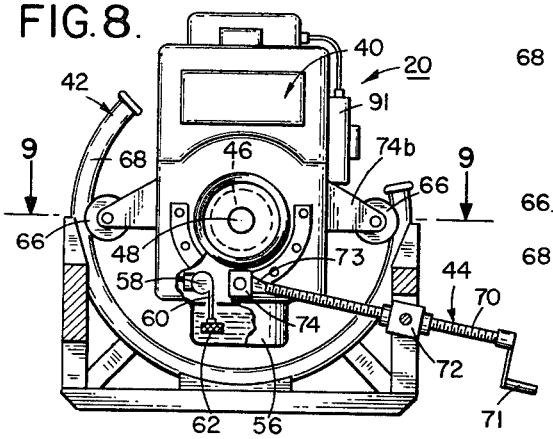
FIG. 8 is an end view, partly in section, of the engine and of the rotatable engine mount which is adjustable for maintaining the engine onslope in an upright position.

A preferred method of the invention is illustrated in FIGS. 1-4, wherein is shown a typical earth structure or embankment, generally designated as 10, in the process of being constructed. Structure 10 is typically built up from a plurality of layers 12, known as "lifts". Each lift is compacted to the prescribed specifications.

In the process of building up the lifts, slough material falls down to fill the steps or stairs 14, thereby forming an uneven, soft, outer slope surface, generally designated as 16.

In most instances it will be a regular slope that is equal to or greater than two-to-one. It is desired that slope 16 be fully compacted to avoid erosion thereof which, in the extreme case, might cause the collapse of the embankment 10 and of any building or pavement supported by the slope.

For regular slopes, the present practice requires that a non-vibratory roller be rolled downslope and then upslope for about three complete passes. But the rolling action of the roller downslope tends to erode the slope, and such erosion is not sufficiently compensated for by the compaction achieved when the roller moves upslope. Consequently, even after three roller passes, the slope remains inadequately compacted. More passes than three would tend to further erode the slope.

In accordance with my invention, the outer surface of a regular slope 16 can now be compaction-stabilized to the same high standards as those specified for the uppermost lift 12*a*.

Essentially, my method involves moving a vibratory compactor up a regular slope, i.e., equal to or greater than two-to-one.

In the usual practice, my method essentially involves releasing a vibratory compactor, generally designated as 20, downslope without vibrating its roller 21 (FIG. 1), and then pulling the roller upslope, while simultaneously vibrating roller 21 (FIG. 2).

The erosion of the outer surface of slope 16, caused during the first pass by the rolling action of the non-vibrating roller 21 downslope, is sufficiently overcome by the compaction produced by the vibrating roller when moving upslope, so that the net compaction produced by roller 21 during its first complete pass on slope 16 is adequate, and the compaction produced during the second pass will be substantially the same as that produced during a complete pass on the uppermost lift 12*a*. For most soils, two passes on slope 16 with roller 21 vibrating upslope only will achieve the prescribed standards of compaction.

The preferred method for moving roller 21 downslope and upslope is with the aid of a cable 22 wound on a winch 24 which is mounted inside a driver's cab 26 on the deck 28 of a self-propelled vehicle 30, such as a truck crane 32. The winch cable 22 is connected to the tongue 27 of frame 25. It is also desired to employ a crane 34 for operating a boom cable 36 which is connected to the top of a lift bracket 23.

To start roller 21 rolling downslope, it is sufficient to gradually unspool winch cable 22 at a rate so as to cause minimum slope erosion. During the downslope rolling action (FIG. 1), boom cable 36 is relaxed. During the upslope rolling action (FIG. 2), winch cable 22 is reeled in at a rate so as to produce maximum compaction per pass, while boom cable 36 is barely taut.

Boom cable 36 serves to prevent the overturning of frame 25, and to hold the compactor 20 in the event of a ruptured winch cable 22. The compactor can be lifted off ground on boom cable 36 (FIG. 3), then moved transversely to the incline of the slope. By progressively driving truck 32 in the direction of the arrow 35 (FIG. 4), sections a–h, etc., of slope 16 can be progressively stabilized. Each section has a width equal approximately to the length of roller 21.

DETAILED DESCRIPTION OF A PREFERRED VIBRATORY COMPACTOR

Throughout the drawings the same numerals are used to designate the same or similar parts to facilitate the understanding of the invention.

Figure 9:
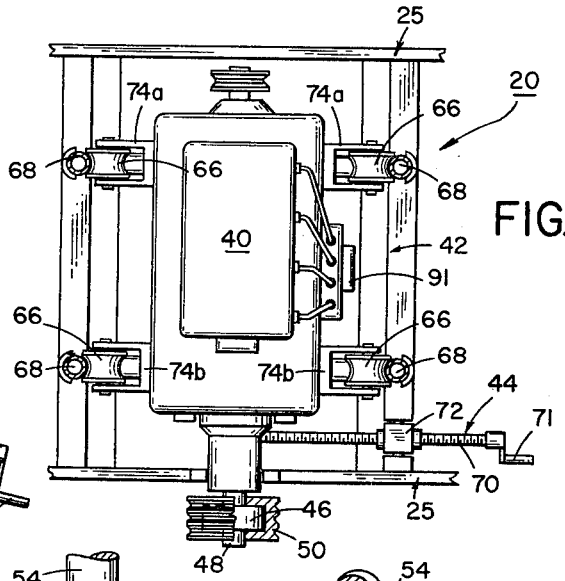
FIG. 9 is a top view of the engine taken on line 9—9 in FIG. 8.
Figure 6:
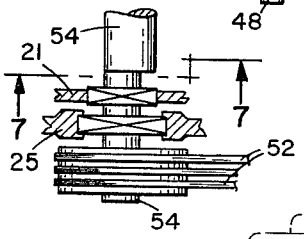
FIG. 6 is a partial view on line 6—6 in FIG. 5.
Figure 7:
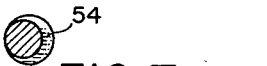
FIG. 7 is a view on line 7—7 in FIG. 6.
Figure 10:
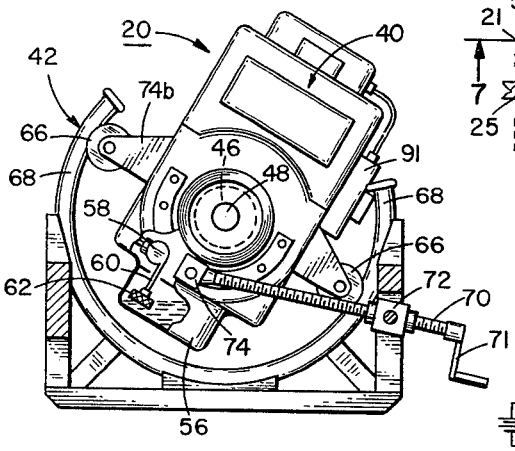
FIG. 10 is a view similar to FIG. 9 with the engine tilted relative to the frame.

Referring to FIGS. 5–10, and in particular to FIG. 5, there is shown a preferred construction of the vibratory compactor 20. On its main frame 25 is rotatably mounted a sheepsfoot roller 21. Other type rollers can be, of course, interchanged depending on the job requirements. An engine 40, typically an air-cooled diesel, is rotatably mounted on an engine support, generally designated as 42 (FIGS. 9 and 10). The engine support has adjustable means 44 for tilting the engine relative to the frame so that it will remain substantially upright while the vibrating roller 21 compacts slope 16.

A centrifugal clutch 46 (FIGS. 6–8) is mounted on the output shaft 48 inside a pulley housing 50. When the RPM of shaft 48 reaches a predetermined value, centrifugal clutch 46 engages the pulley housing 50 for transmitting a torque through belts 52 to the vibratory shaft 54 of roller 21. Vibratory shaft 54 is eccentric (FIG. 7), and its eccentricity causes roller 21 to vibrate. At its lowermost end, engine 40 has an oil pan 56 in which is housed a pump 58 having a suction pipe 60 coupled to a filter screen 62 positioned at the bottom of the pan.

When the engine is upright, the screen is continuously covered with the engine lubricating oil. If a running engine were to be tilted excessively relative to the vertical, a portion of screen 62 would not be covered with oil. Allowing air suction by pump 58, would cause the complete destruction of the engine for lack of lubrication.

Accordingly, if the engine were fixedly mounted in an upright position on frame 25, as is conventional, the movement of the vibratory compactor on a regular slope (equal to or greater than two-to-one) with the engine running would cause air suction and the ensuing destruction of the engine.

Except for the tilting engine support means 42, the vibratory compactor as thus far described is conventional, and no detailed description thereof is required.

In a preferred embodiment of the invention, the engine support 42 comprises two pairs of spaced-apart brackets 74*a*, 74*b* (FIG. 9). Each bracket rotatably supports a concave roller 66 on an arcuate tubular rail or track 68. The adjustable engine tilt means 44 includes a threaded shaft 70 rotatable by a hand crank 71. The shaft rotates inside a floating threaded block 72. The outer end of the shaft has a knuckle joint 73 (FIG. 8) which is coupled to a bell housing bracket 74. The length of the shaft portion between the threaded block 72 and bracket 74 will determine the amount of engine tilt relative to the main frame 25.

It will be appreciated that other means may be provided than the relatively-simple, manually-adjustable, engine tilt means 44. The amount of tilt is pre-adjusted with the foreknowledge of the inclination of slope 16 to be worked upon. In this fashion, engine 40 will remain substantially upright, while the stabilization of slope 16 is being carried out by compactor 20. With the engine running upright, adequate lubrication thereof will always be achieved.

Since many regular slopes may have a length ranging from 200 to 400 feet, it is desired to provide remote control means for initiating and stopping the vibratory action of the roller 21, and in case of emergency, for stopping the engine 40.

Figure 11:
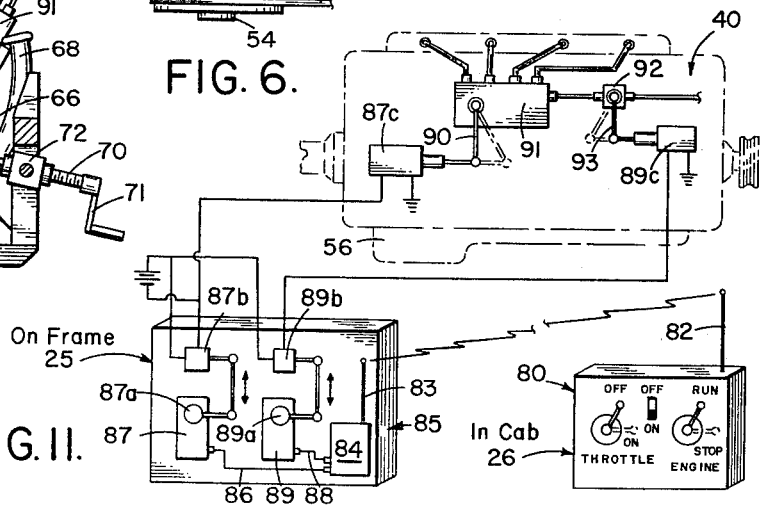
FIG. 11 is a schematic representation of remote control means for controlling the operation of the engine.

For that purpose, there is provided in the cab 26 (FIGS. 4 and 11) a radio transmitter 80 adapted to emit radio signals over an antenna 82 which are detected by the antenna 83 of a radio receiver 84 in a control box 85 mounted on the main frame 25. The radio receiver has one output line 86, connected to a first servo unit 87 having a rotatable element 87*a*, and another output line 88 connected to a second servo unit 89 having a rotatable element 89*a*.

The rotatable elements 87*a*, 89*a* mechanically coupled and adapted to operate toggle switches 87*b*, 89*b*, respectively. Toggle switch 87*b* controls the electric energization of a solenoid 87*c*, and toggle switch 89*b* controls the energization of a solenoid 89*c*. Solenoid 87*c* is connected to the conventional throttle lever 90 on the engine's fuel injection pump 91. Throttle lever 90 is normally in its idle position (solid lines) and can be moved by solenoid 87*c* to its "run" position (broken lines).

When lever 90 is in its idle position, engine 40 runs at an insufficient RPM to operate the centrifugal clutch 46 on output shaft 48 (FIG. 9). When lever 90 is in its run position, the centrifugal clutch 46 will rotate pulley housing 50, thereby transmitting a torque to the eccentric vibratory shaft 54 (FIG. 6), causing roller 21 to shake. The vibrations of roller 21 produce very strong compaction forces, as is well known in the art.

The fuel injection pump 91 (FIG. 11) is conventionally connected to the fuel reservoir (not shown) through an emergency fuel shut-off valve 92 which is controllable by a lever 93. Solenoid 89*c* is connected to lever 93 which is normally in its "run" position (solid lines) and can be moved by solenoid 89*c* to its "stop" position (broken lines). When lever 93 is in its run position, the fuel passes freely through the fuel shut-off valve 92. When lever 93 is in its stop position, no fuel can pass through valve 92, thereby stopping the engine.

Both solenoids 87*c* and 89*c* are powered by a battery 96 and are normally de-energized by the toggle switches 87*b*, 89*b* which normally are in their "off" positions. Each toggle switch can be independently and remotely turned "on" by an electric signal received on line 86 or line 88 for energizing servo 87 or servo 89.

Accordingly, the operation of the engine can be fully and remotely controlled by a single operator from the crane compartment 26, by merely transmitting two distinct radio signals.

While the method and apparatus of my invention have been described with reference to specific embodiments thereof, it will be appreciated by those skilled in the art, that many variations are possible and all such variations are contemplated to fall within the scope of the claims appended hereto.

What is claimed is:

1. A compactor comprising:

a frame, a compaction roller rotatably mounted on said frame, an eccentric vibratory shaft extending through said roller, engine support means mounted on said frame, an engine rotatably mounted on said support means;

remote control means for remotely operating said engine thereby remotely controlling the vibration of said roller, said remote-control means including:

a remotely-positioned radio transmitter, a radio receiver mounted on said frame, and means coupled to said radio receiver and being responsive to the received radio signals for controlling the operation of said engine; and means for selectively engaging said vibratory shaft with said engine, thereby vibrating said roller.

2. A compaction system for stabilizing an earth fill slope, said slope being at least two-to-one, said system comprising:

a compaction roller, means coupled to said compaction roller for selectively vibrating said roller, said means comprising a frame rotatably supporting said roller, an engine mounted on said frame; and means for adjusting the tilt of the engine relative to said frame;

a self-propelled vehicle adapted to move on top of said slope, a crane mounted on said vehicle, said crane having a boom cable connected to said roller and being adapted to lift said roller from said slope for moving said roller transversely of said slope, a winch having a winch cable operatively-mounted on said vehicle, means coupling said winch cable to said roller, a radio transmitter on said vehicle, control means on said frame including a radio receiver, and said transmitter transmitting electromagnetic signals to said receiver for controlling the vibration of said roller; and means powering said winch for pulling said roller upslope while said roller is vibrating and for lowering said roller downslope while said roller is non-vibrating.

3. A method of compacting a bank having at least a two-to-one slope, comprising:

(a) providing a vibratory compactor including a frame, a compaction roller rotatably mounted on said frame, an internal combustion engine movably mounted on said frame for controllably vibrating said roller, and said engine having an inclination relatived to said slope to allow for the proper lubricating of said engine;

(b) stopping the vibration of said compaction roller, and moving said compaction roller downslope to the foot of said bank, (c) vibrating said compaction roller at the foot of said bank; and (d) moving said vibrating compaction roller upslope, thereby compacting said bank.

4. The method of claim 3, and remotely controlling the vibration of said roller

5. The method of claim 4, wherein the vibration of said roller is remotely controlled by electromagnetic signals.

* * * * *